United States Patent [19]

Holbrook et al.

[11] Patent Number: 4,612,663

[45] Date of Patent: Sep. 16, 1986

[54] MULTICHANNEL AUDIO REPRODUCTION SYSTEM

[76] Inventors: Kyle A. Holbrook; Michael J. Yacavone, both of P.O. Box 135 University Station, Syracuse, N.Y. 13210

[21] Appl. No.: 593,260

[22] Filed: Mar. 26, 1984

[51] Int. Cl.[4] ..... H04R 5/00

[52] U.S. Cl. ..... 381/24; 381/18; 381/1

[58] Field of Search ..... 381/24, 1, 17, 18, 19, 381/27

[56] References Cited

U.S. PATENT DOCUMENTS

| | | | |
|---|---|---|---|
| 3,632,886 | 1/1972 | Schieber . | |
| 3,697,692 | 10/1972 | Hafler . | |
| 3,745,254 | 7/1973 | Ohta et al. . | |
| 3,757,047 | 9/1973 | Ito et al. . | |
| 3,783,192 | 1/1974 | Takahashi . | |
| 3,885,101 | 5/1975 | Ito et al. . | |
| 3,892,917 | 7/1975 | Sotome . | |
| 3,971,890 | 7/1976 | Bauer . | |
| 4,489,432 | 12/1984 | Polk | 381/24 |

OTHER PUBLICATIONS

Berger "Observations and Reservations About Four--Channel, SR/Jul. 25, 1970; p. 51.

Hafler, "A New Quadraphonic System", Audio, Jul. 1970; pp. 24, 26, 56–57.

*Primary Examiner*—Forester W. Isen

*Attorney, Agent, or Firm*—Finnegan, Henderson, Farabow, Garrett & Dunner

[57] ABSTRACT

A multichannel reproduction system for use with a source providing left (L) and (R) signals includes circuitry for developing difference signals L−R and R−L which are delivered to individual ones of four speakers arranged in a specific T-configuration. The L and R signals are delivered to the left and right speakers in the T-configuration, respectively, while the top speaker in the "T" between the left and right speakers receives the L−R signal and the bottom speaker at the foot of the "T" receives the R−L signal. Alternately, the L−R signal is delivered to the top speaker and the R−L signal to the bottom speaker.

16 Claims, 3 Drawing Figures

MULTICHANNEL AUDIO REPRODUCTION SYSTEM

BACKGROUND OF THE INVENTION

1. Field of the Invention

The present invention relates to the field of multichannel audio reproduction systems and, more particularly, to a system for producing tri-ambient synthesized audio signals from a stereo source.

2. The Prior Art

The art is replete with systems designed to reproduce faithfully music recordings and other audio sounds. The most familiar of these systems involves the use of stereo signals, namely, simultaneously recording two separate signals and subsequently reproducing these signals through separate speakers. Generally, the signals correspond to left and right channels which have been derived from microphones positioned to the left and right of a recording stage, for example.

In an effort to improve on the two-speaker stereo arrangement, it has also been known to provide additional speakers driven by the left and right stereo channels. For example, enhanced reproduction can be achieved by providing speakers at the rear of a listening room to complement stereo speakers situated at the front of the room. In this manner, the area within the room at which the stereo signals coincide is effectively enlarged, leading to increased utilization of the room's listening area.

In the systems discussed above, the signals delivered to the speakers are generally maintained in phase with each other. That is, in response to a particular signal appearing on all channels, all of the speaker cones are driven in unison in identical directions. It is also known in the art, however, to provide systems utilizing signals which are out-of-phase with each other. Examples of such prior art devices are disclosed in U.S. Pat. Nos. 3,757,047 and 3,697,692.

One manner in which such out-of-phase signals can be derived is to provide signals resulting from various combinations of the left and right channel stereo signals. Further, the effect of such out-of-phase signals may be enhanced by delivering these signals to speakers arranged in predetermined configurations about a listener. In U.S. Pat. No. 3,745,254, for example, a reproduction system is disclosed in which four speakers spaced equidistantly apart relative a listener are provided with left (L), right (R), left minus right (L−R), and right minus left (R−L) signals, respectively.

According to this patent, however, superior reproduction is not achieved unless a phase shift is also introduced between the two difference signals. In order to introduce such a phase shift, it is necessary to utilize a variety of active electrical circuits, adding considerably to the cost of such a system. Furthermore, the presence of these additional components increases the likelihood of a breakdown occurring in the field, which breakdown may even affect other components in the system.

SUMMARY OF THE INVENTION

Accordingly, it is an object of the invention to provide multichannel audio characterized by a superior sense of realism, depth and presence with respect to conventional stereo systems.

It is another object of the present invention to implement a multichannel reproduction system without need for electrical phase shifting circuitry.

A further object of the invention is to provide a wider horizontal soundstage in front of a listener, thereby increasing the area within a room wherein the listener may perceive stereophonic sound.

Additional objects and advantages of the present invention will be set forth in part in the description that follows and in part will be obvious from the description or may be learned by practice of the invention. The objects and advantages of the invention may be realized and obtained by the methods and apparatus particularly pointed out in the appended claims.

To achieve the objects and in accordance with the purpose of the invention, as embodied and as broadly described herein, a multichannel reproduction system for a source producing left (L) and right (R) signals comprises: four speakers arranged in a T-configuration, the speaker at the top left portion of the "T" being the left speaker, the speaker at the top right portion being the right speaker, the speaker at the top center portion being the front speaker, and the speaker at the bottom portion being the back speaker; first means coupled to the source and to the left speaker for delivering the L signal to the left speaker; second means coupled to the source and to the right speaker for delivering the R signal to said right speaker; third means coupled to the source and to one of the front or the back speakers for delivering to the one speaker a signal equal to the L signal minus the R signal (an L−R signal); and fourth means coupled to the source and to the other one of the front or the back speakers for delivering to the other one speaker a signal equal to the R signal minus the L signal (an R−L signal).

The accompanying drawings, which are incorporated in and constitute a part of this specification, illustrate presently preferred embodiments of the invention and, together, with the description, serve to explain the principles of the invention.

DESCRIPTION OF THE PREFERRED EMBODIMENT

Figure 1:
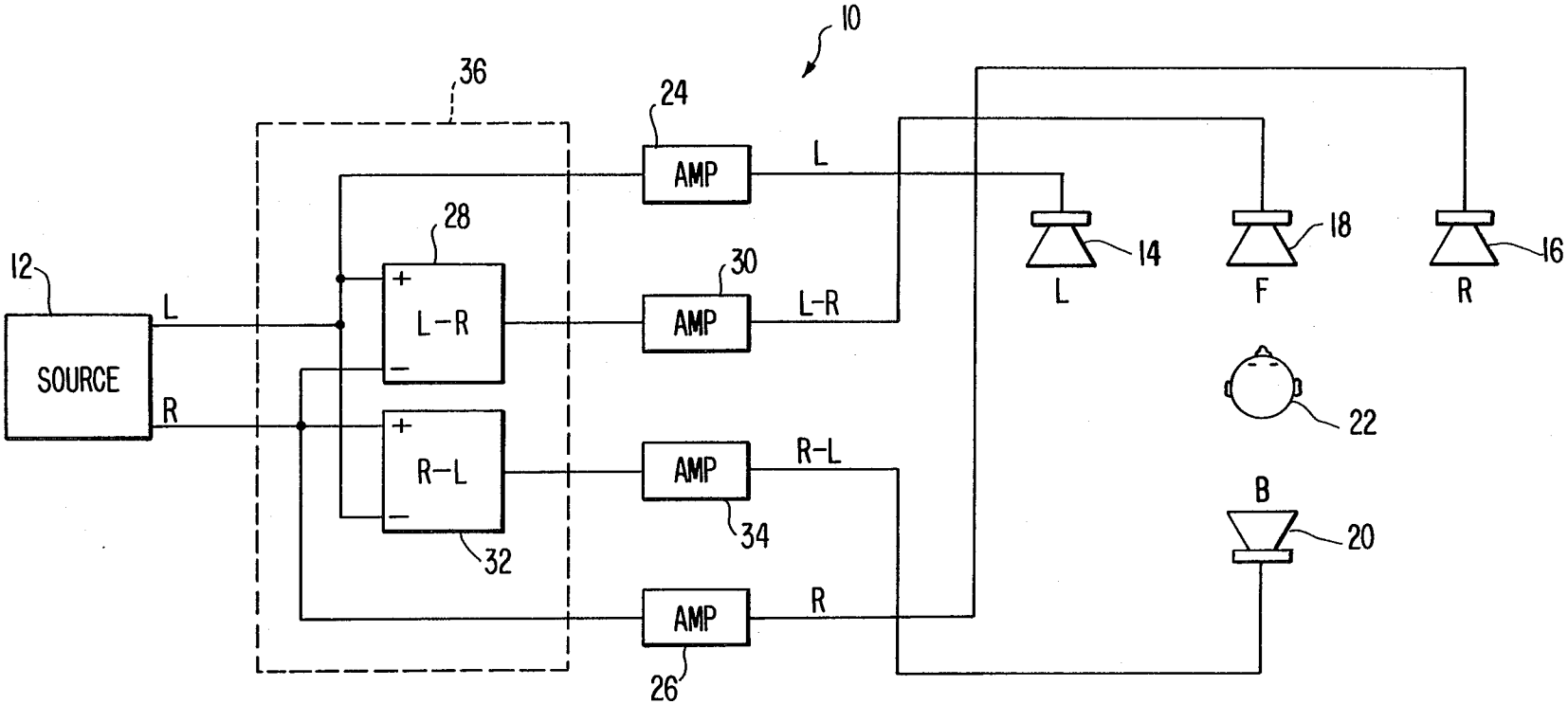
FIG. 1 is a block diagram of a multichannel reproduction system according to the present invention.

Reference will now be made in detail to a presently preferred embodiment of the invention, an example of which is illustrated in the accompanying drawings. Throughout the drawings, like reference characters are used to designate like elements.

A preferred embodiment of the multichannel reproduction system of the present invention is illustrated in block diagram form in FIG. 1. The reproduction system, generally designated 10, operates upon signals generated by a source 12 which produces left (L) and (R) signals, i.e., stereo. Thus, source 12 may comprise a turntable, tape recording equipment, a receiver or other known signal source. Furthermore, it is to be understood that the multichannel reproduction system of the present invention may operate with a live source, such as a concert performance, in which case source 12 may comprise microphones and related acoustic equipment, such as a mixing console.

According to the present invention, four speakers are provided arranged in a T-configuration, the speaker at the top left portion of the "T" being the left speaker, the speaker at the top right portion being the right speaker, the speaker at the top center portion being the front speaker and the speaker at the bottom portion being the back speaker. As embodied herein, the four speakers are designated 14, 16, 18 and 20, and define left speaker 14, right speaker 16, front speaker 18, and back speaker 20. For purposes of reference, the speakers as illustrated in FIG. 1 are shown relative a person 22.

By the term "T-configuration" is meant the placement of four loudspeakers such that the left, front and right loudspeakers, 14, 15 and 16, respectively, are arranged in a plane in front of and perpendicular to centrally located listener 22, with the sound being emitted toward the listener and the back of the room. The back loudspeaker 20 is located directly behind listener 22 in a plane perpendicular to the centrally located listener, with sound from speaker 22 being emitted toward the listener and the front of the room. Depending upon the directional characteristics of the specific loudspeakers used, it may be desirable to aim the left and right speakers slightly to the outside of the central listener, i.e., aim left speaker 14 more left and right speaker 16 more right. This will further increase the area of the room receiving direct sound from the loudspeakers and will also increase the stereo effect. In contrast, it has been found that aiming the left and right speakers inward toward the listener slightly degrades the stereophonic effect.

Speakers 14, 16, 18 and 20 may comprise any of several well-known speaker designs. Typically, such speakers are four or eight ohms in impedance and, preferably, operate over a broad frequency range within the spectrum of human hearing, such as 20 Hz to 25 KHz. It is to be understood that the type of speaker used can be varied without departing from the spirit or scope of the present invention.

According to the invention, first means are provided coupled to the source and to the left speaker for delivering the L signal to the left speaker. As embodied herein, the first means comprise amplifier 24 which has an input connected to source 12 to receive the L signal and an output coupled to drive left speaker 14. Amplifiers suitable for driving speakers based on signals produced by stereo sources are well known in the art and need not be described in further detail herein for purposes of the present invention.

The invention also includes second means coupled to the source and to the right speaker for delivering the R signal to the right speaker. As embodied herein, the second means comprises amplifier 26. An input of amplifier 26 is coupled to source 12 so as to receive the R signal, while its output is coupled to drive right speaker 16. Amplifier 26 may be of a design similar to that of amplifier 24.

According to the present invention, third means are provided coupled to the source and to one of the front or the back speakers for delivering to said one speaker a signal equal to the L signal minus the R signal (an L−R signal). As embodied herein, the third means comprises differential circuit 28 and amplifier 30. According to a preferred embodiment of the invention, amplifier 30 is coupled to front speaker 18 such that difference signal L−R is delivered in front of listener 22. Differential circuit 28 has a "+" and a "−" input, the former being coupled to source 12 to receive the L signal whereas the latter is coupled to source 12 to receive the R signal. Differential circuit 28 is of a well-known construction capable of producing an output signal equal to L−R; an example of such a circuit is described hereinbelow with respect to FIG. 3. This output signal (L−R) is delivered to the input of amplifier 30 which may be of a construction similar to that of amplifiers 24 and 26, such that an amplified L−R signal is delivered to front speaker 18.

In another embodiment of the invention, not shown in the drawings, amplifier 30 is coupled to back speaker 20 instead of front speaker 18. Thus, the L−R diffference signal is delivered to the speaker in back of the listener. This alternative embodiment is discussed in further detail hereinbelow.

In accordance with the present invention, fourth means are provided coupled to the source and to the other one of the front or the back speakers for delivering to said other one speaker a signal equal to the R signal minus the L signal (an R−L signal). As embodied herein, the fourth means comprises differential circuit 32 coupled to amplifier 34. According to a first embodiment, amplifier 34 is coupled to back speaker 20 such that difference signal R−L is delivered in back of listener 22. Differential circuit 32, of a construction similar to that of differential circuit 28, is connected to source 12 so as to deliver a signal equal to R−L to amplifier 34. Accordingly, amplifier 34, which is of a construction similar to that of amplifiers 24, 26 and 30, delivers an amplified R−L signal to speaker 20.

In another embodiment of the invention, not shown in the drawings, amplifier 34 is coupled to front speaker 18 instead of back speaker 20. Thus, the R−L difference signal is delivered to the speaker in front of the listener. This alternative embodiment is discussed in further detail hereinbelow.

From the foregoing, it can be appreciated that the multichannel reproduction system according to the present invention utilizes stereo signals derived from a source 12, the signals being treated to produce a variety of signals L, R, L−R and R−L, which are then amplified by amplifiers 24, 26, 30 and 34, with the resulting amplified signals being delivered to speakers 14, 16, 18 and 20, respectively, placed in the above-described T-configuration. The circuitry responsible for developing the variety of signals may be termed a "tri-ambient synthesizer" and is generally designated by dotted lines 36 in FIG. 1. The specific circuitry comprising synthesizer 36 is discussed in further detail hereinbelow.

Amplifiers 24, 26, 30 and 34 coupled to synthesizer 36 may conveniently be grouped so as to comprise two stereo amplifiers. According to a preferred embodiment of the invention, tri-ambient synthesizer 36 may include preamplifier controls, such as volume, bass, treble and the like. It should be appreciated, however, that variations in the controls, and which amplifier(s) the controls are associated with, can be made without departing from the spirit or scope of the present invention.

In operation, stereo signals L and R produced by source 12 are amplified and delivered to left and right speakers 14 and 16 in a known fashion. Simultaneously, differential circuits 28 and 32 of tri-ambient synthesizer 36 create difference signals L−R and R−L which are then amplified and delivered, respectively, to front and back speakers 18 and 20. Thus, a person 22 is provided with both conventional in-phase stereo via speakers 14 and 16, as well as out-of-phase audio from front and back speakers 18 and 20, which audio results from the difference signals. This acoustic phase inversion arrangement causes the listener 22 to perceive musical sounds with much greater depth, realism and presence as compared with a conventional stereo comprising left and right speakers only.

In experimental tests conducted to compare the present invention with conventional systems, perceptual terms such as "added dimensionality", "loss of loudspeaker localization", "widening" or "opening" of the sound stage have been expressed by many listeners. Others have stated that they perceived individual instruments contained within the music source as if heard from specific points within the listening room. The effect is chiefly psychoacoustic in nature, that is, it must be heard and cannot be recorded. It will sound different each time it is listened to, and will also sound different in different areas of the listening room. Nevertheless, evidence of the advantages of the present invention over conventional systems, the following comparison data is believed to be illustrative.

In a series of blind listening tests, subjects were asked to judge the quality of sound produced by a system according to the present invention against that produced by normal stereo. Eighteen direct comparisons were performed by each subject. The subjects were not aware of the nature of the study, nor were they previously familiar with the experimenters or the invention. They were asked only to state their preference for either "System A" or "System B". The following variables were all randomized: the order of the music presented, the system that the subject heard first (System A or B), and what signals were sent to System A or B. The subjects were asked to judge the systems based on the following qualities of the reproduced sound: which was most natural and pleasing, which presented more depth and presence, and which had more realism and quality.

The subjects were seated, in turn, in a "stereo seat" positioned equidistant from all four loudspeakers. They were allowed to switch between System A and System B as often as desired. Each subject heard three pieces of music chosen by the experimenters and three chosen by the subject from a list of fifteen possible selections. The types of music ranged from solo acoustic guitar recordings to currently popular jazz and rock albums to modern electronic and acoustic orchestral compositions.

As used in the following tables, "Serious Listeners" were those who owned expensive (audiophile) stereo systems or had experience with electronic equipment. "Casual Listeners" often owned inexpensive stereo equipment, but attended musical events, e.g. concerts, ballets or the symphony, or often went out dancing. Also as used in the following tables, "Enhanced Stereo" refers to a system using the present invention, and "Normal Stereo" to a system using only two loudspeakers.

TABLE 1

| | Overall Listener Preferences | |
|---|---|---|
| | Serious Listeners | Casual Listeners |
| Enhanced Stereo | 59% | 47% |
| Normal Stereo | 29% | 33% |
| Neutral Response | 12% | 19% |

Table 1 reveals that in the blind listening tests, serious listeners preferred the enhanced stereo of the present invention by a thirty percent margin over normal stereo, with twelve percent being neutral. As to casual listeners, the sound produced by the present invention was preferred by fourteen percent of the listeners over normal stereo, with nineteen percent remaining neutral. The more a subject has listened to music, the greater is the impression created by the present invention.

TABLE 2

| | Listener Preference by Music Familiarity | |
|---|---|---|
| | Music chosen by the subjects | Music chosen by the experimenters |
| Enhanced Stereo | 56% | 50% |
| Normal Stereo | 28% | 38% |
| Neutral Response | 17% | 12% |

Table 2 shows that a subject familiar with the music being played will notice a greater difference as to the qualities of the present invention as compared to playing the same selection on a normal stereo. When listening to unfamiliar selections, subjects preferred the present invention by only a twelve percent margin whereas, when listening to familiar music, the margin of preference increased to twenty eight percent. When familiar with the music being played, a person will prefer the sound as reproduced by a system according to the present invention.

TABLE 3

| | Listener Preference With Experience | | |
|---|---|---|---|
| | First Trial Set | Second Trial Set | Third Trial Set |
| Enhanced Stereo | 36.5% | 55.5% | 67% |
| Normal Stereo | 26.5% | 33.25% | 33% |
| Neutral Response | 36.75% | 12.5% | 0% |

Table 3 reflects listener preferences as they changed over the course of several trial sets, each set consisting of responses to six different musical selections. As evidenced by the Table, listener preferences shift in favor of the enhanced stereo of the present invention as more listening time elapsed.

For every subject the current invention was found to be preferable. This is most clearly demonstrated by the responses of the serious listeners. In personal interviews conducted immediately after each experiment, subjects often responded in a manner that would suggest that they did not know which system they were listening to at any given moment. Saying that the difference was "subtle" or "hard to define", many subjects said that each system was good in a unique way or that they had no personal preference. Nevertheless, it should be noted that the responses clearly shifted towards the present invention as the trials progressed.

Figure 2:
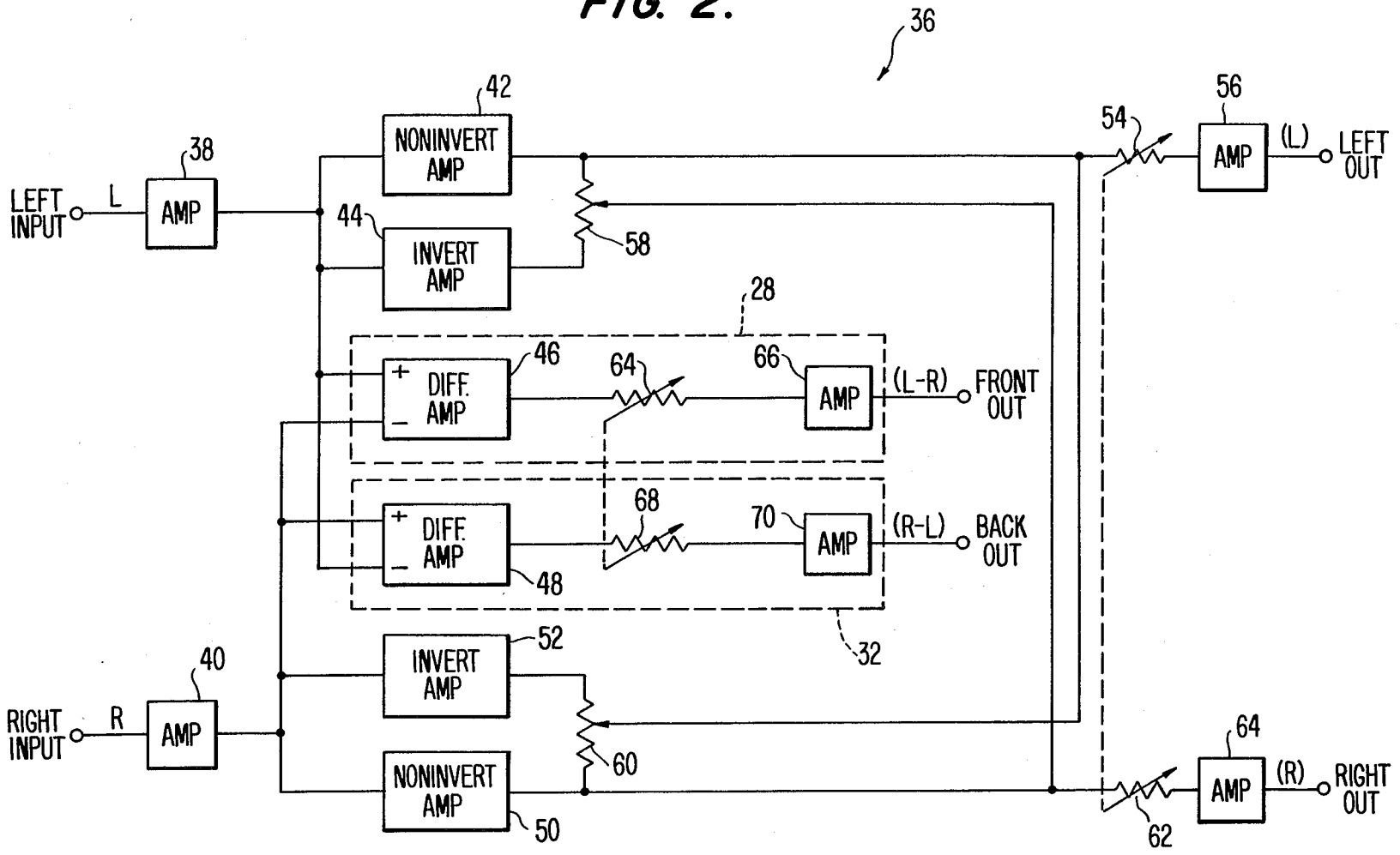
FIG. 2 is a detailed block diagram of a preferred embodiment of a tri-ambient synthesizer contained within the dotted lines of FIG. 1.

A detailed block diagram of tri-ambient synthesizer 36 is shown in FIG. 2. The synthesizer includes buffer amplifiers 38 and 40 connected, respectively, to receive the left and right signals delivered by source 12. The buffer amplifiers, of a design well known in the art, serve to isolate the synthesizer from source 12 such that further processing of the L and R signals may be accomplished within the synthesizer without unduly loading down the output of source 12. According to the presently preferred embodiment, which is explained in further detail herein below with respect to FIG. 3, all of the amplifiers comprising tri-ambient synthesizer 36 are made of operational amplifiers arranged in conventional, well-known configurations.

The output of amplifier 38 is coupled to the input of a non-inverting amplifier 42, to an inverting amplifier 44, to the "+" input of a differential amplifier 46, and to the "−" input of a differential amplifier 48. Similarly, the output of amplifier 40 is coupled to the input of a non-inverting amplifier 50, to inverting amplifier 52, to the "+" input of differential amplifier 48, and to the "−" input of differential amplifier 46. The output of non-inverting amplifier 42 is coupled through a potentiometer 54 to an output amplifier 56, the output of which drives amplifier 24 (FIG. 1). Further, the output of non-inverting amplifier 42 is coupled through a potentiometer 58 to the output of inverting amplifier 44, and to the wiper of another potentiometer 60. In similar fashion, the output of non-inverting amplifier 50 is coupled through a potentiometer 62 to an output amplifier 64, the output of which drives amplifier 26 (FIG. 1). Further, the output of non-inverting amplifier 50 is coupled to the output of inverting amplifier 52 through potentiometer 60 and to the wiper of potentiometer 58.

According to a preferred embodiment, potentiometers 54 and 62 are coupled together, as are potentiometers 58 and 60, such that the wipers of each potentiometer pair may be moved in unison.

The output of differential amplifier 46, comprising the L−R signal, is delivered through a potentiometer 64 to an output amplifier 66. The output signal delivered by amplifier 66 is connected to amplifier 30 (FIG. 1). Similarly, the output of differential amplifier 48 is coupled through a potentiometer 68 to an output amplifier 70. The output of amplifier 70 drives amplifier 34 (FIG. 1) such that the back speaker is driven by the amplified R−L signal. According to a preferred embodiment, the wipers of potentiometers 64 and 68 are coupled together so as to be moved in unison.

Potentiometers 54, 62, 64 and 68 serve as master volume controls for the left, right, front and back speakers, respectively. That is, by ganging the potentiometers in the abovedescribed manner, "master" volume controls are provided wherein the volume of the left and right spakers can be adjusted simultaneously, as can the volume of the front and back speakers. It should be appreciated, however, that this ganging arrangement may be eliminated so as to provide separate controls for each speaker or may be arranged so as to tie together all four of the potentiometers and provide a single "master" control. Furthermore, in conjunction with the potentiometers shown in FIG. 2, additional potentiometers may be provided to serve as volume controls for the respective speakers, individually. Thus, a separate potentiometer could be employed for each speaker apart from gauged potentiometers 54, 62, 64 and 68 so as to provide individual speaker volume controls in addition to the "master" control arrangements. None of these variations are considered to depart from the spirit or scope of the present invention.

Potentiometers 58 and 60 provide a "blend" control which serves to introduce components of the L and R signals into the right and left speakers, respectively. That is, the signal delivered to left speaker 14 may be varied from an L−R signal to an L signal to an L+R signal, whereas the signal delivered to right speaker 16 may range from L−R signal to an R signal to an L+R signal, all by operation of the "blend" control. According to a preferred embodiment, potentiometers 58 and 60 are ganged so as to operate together. In normal operation, the blend control is set such that the left and right speakers are provided with L and R signals, respectively; preferably, such a natural setting occurs at the center of rotation of ganged potentiometers 58 and 60. By rotating the blend control to its extreme in either direction, identical signals may be presented to both the left and right speakers, thus producing a mono, i.e. the same, signal in each of speakers 14 and 16. Accordingly, as the blend control is rotated from one extreme through its center position to the other extreme, speakers 14 and 16 are presented with signals which are varied continuously from a dual difference signal to a true stereo signal to a dual sum signal. This has the effect of causing the music to "rotate" as the blend control is turned. With each type of musical source 12, the audible effect to a listener 22 is quite different, and may or may not be pleasing to the ear. The blend control has no effect upon the front and back speakers, however.

Figure 3:
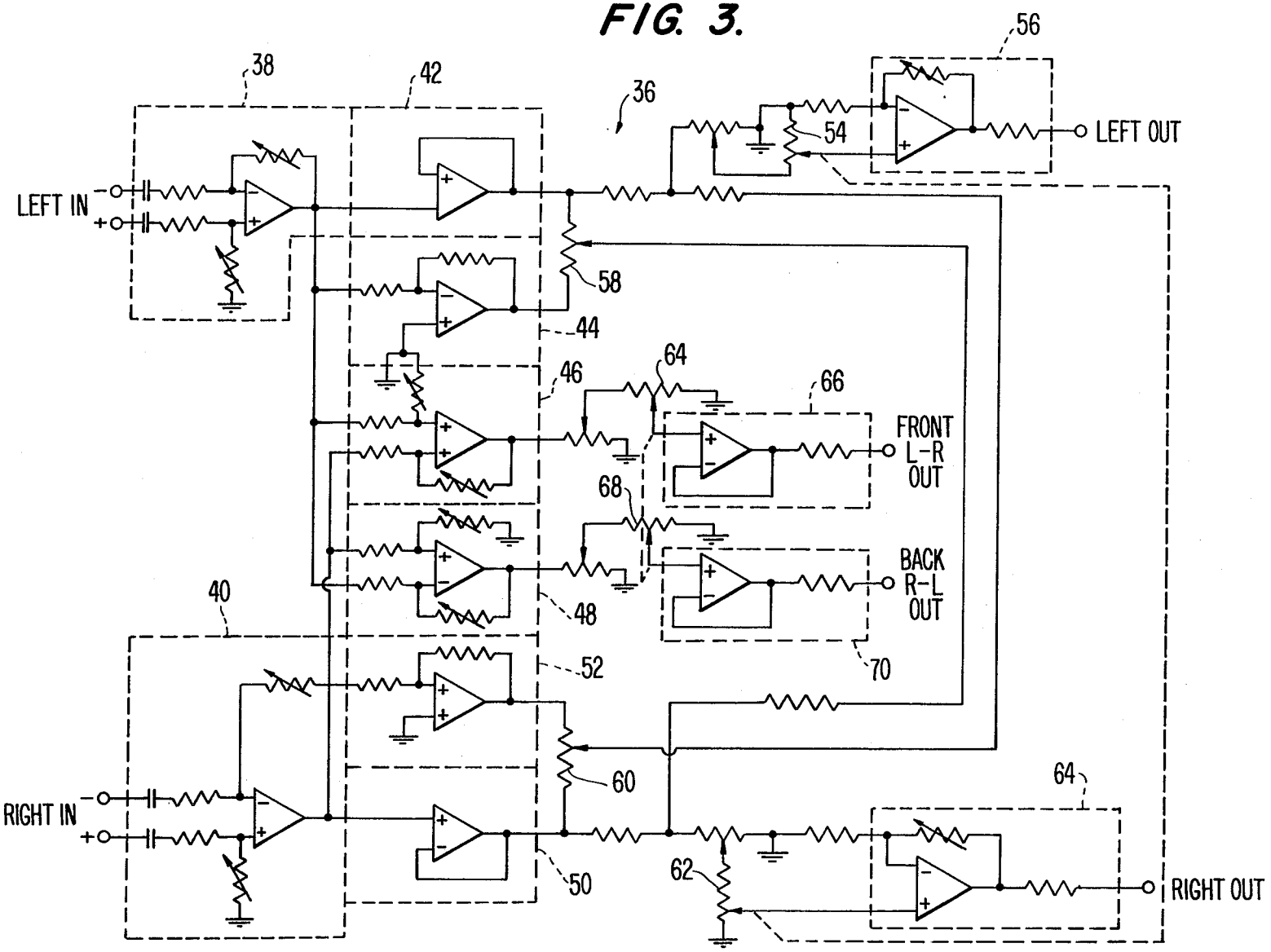
FIG. 3 is a schematic diagram of the tri-ambient synthesizer of FIG. 2.

A detailed circuit diagram of tri-ambient synthesizer 36 is illustrated in FIG. 3 in which the various amplifiers illustrated in block diagram in FIG. 2 are depicted by the dotted lines bearing the identical reference characters. The effect of the individual amplifier blocks are accomplished by using operational amplifiers. Each of the amplifier blocks is contructed in a well-known manner such that further discussion of the details of construction is believed to be unnecessary for purposes of understanding the present invention.

The tri-ambient synthesizer illustrated in FIG. 3 has as basic components the following types of configurations of operational amplifiers: positive feedback buffer amplifiers 38 and 40; negative feedback noninverting amplifiers 42, 50, 56, 64, 66 and 70; inverting amplifiers 44 and 52; and differential amplifiers 46 and 48. It is to be understood, however, these are merely exemplary and that other amplifier configurations and arrangements may be employed without departing from the spirit or scope of the present invention.

As stated previously, an alternative embodiment of the present invention is envisioned in which the L−R difference signal is delivered to back speaker 20 whereas the R−L difference signal is delivered to front speaker 18. The electrical connections and modifications necessary to accomplish this alternative embodiment are considered to be obvious to one of ordinary skill in view of the foregoing description of the preferred embodiment of the invention. While this alternative embodiment involves an electroacoustic difference relative to the preferred embodiment, it has been found that no psychoacoustic difference results. That is, a system constructed according to the alternative embodiment delivers the same enhanced stereo signals as those tested and described hereinabove in connection with the preferred embodiment.

In view of the foregoing, the present invention may be summarized as a multichannel reproduction system which provides both in-phase and out-of-phase audio to a plurality of speakers arranged in a T-shaped configuration. The left and right speakers of the configuration deliver left (L) and right (R) audio, respectively, whereas the front and back speakers deliver difference signals, L−R and R−L. As a result, a listener perceives a higher sense of realism and depth in comparison with conventional stereo systems.

A further advantage of the present invention is that it widens the effective stereo seating within the listening room over that achieved by conventional systems. Moreover, due to the placement of the speakers, large listening rooms may be provided with a sound of higher quality than that achieved by conventional systems, at a reduced level of power amplification. For example, a system constructed according to the present invention requires minimum power amplification (80–100 watts per loudspeaker, typically) for large, club-sized rooms, as compared to the larger power amplification (200–400 watts) which usually is needed for conventional systems. This is especially helpful in view of the difficulties encountered with construction of high quality, high powered amplifiers as opposed to high quality, lower powered amplifiers.

It will be apparent to those skilled in the art that modifications and variations can be made in the multichannel reproduction system of this invention. The invention in its broader aspects is, therefore, not limited to the specific details, representative methods and apparatus, and illustrative examples shown and described hereinabove. Thus, it is intended that all matter contained in the foregoing description or shown in the accompanying drawings shall be interpreted as illustrative and not in a limiting sense.

What is claimed is:

1. A multichannel reproduction system for a source producting left (L) and right (R) signals, comprising:

four speakers arranged in a T-configuration, the speaker at the top left portion of the "T" being the left speaker, the speaker at the top right portion being the right speaker, the speaker at the top center portion being the front speaker, and the speaker at the bottom portion being the back speaker, said left, front and right speakers being disposed in a first common vertical plane, and said front and back speakers being disposed in a second common vertical plane perpendicular to said first common vertical plane;

first means coupled to the source and to the left speaker for delivering the L signal to said left speaker;

second means coupled to the source and to the right speaker for delivering the R signal to said right speaker;

third means coupled to the source and to one of said front speaker or said back speaker for delivering to said one speaker a signal equal to the L signal minus the R signal; and fourth means coupled to the source and to the other one of said front speaker or said bakc speaker for delivering to said other one speaker a signal equal to the R signal minus the L signal.

2. The system recited in claim 1 wherein said first means includes an amplifier for amplifying the L signal delivered by the source.

3. The system recited in claim 1 wherein said second means includes an amplifier for amplifying the R signal delivered by the source.

4. The system recited in claim 1 wherein said third means includes differential means coupled to the source for receiving the L and R signals and for delivering the L−R signal, and an amplifier coupled to said differential means for amplifying the L−R signal delivered by said differential means.

5. The system recited in claim 1 wherein said fourth means includes differential means coupled to the source for receiving the L and R signals and for delivering the R−L signal, and an amplifier coupled to said differential amplifier for amplifying the R−L signal delivered by said differential means.

6. The system recited in claim 1 wherein said third means is coupled to said front speaker and said fourth means is coupled to said back speaker.

7. The system recited in claim 1 wherein said third means is coupled to said back speaker and said fourth means is coupled to said front speaker.

8. The system recited in claim 1 further comprising means coupled to said source and to said first and second means for blending the L and R signals produced in said left and right speakers, respectively.

9. A multichannel reproduction system for delivering audio signals derived from a source producing left (L) and right (R) signals to a person facing a predetermined direction, comprising:

first means coupled to said source for providing an audio signal originating in front of and to the left of said person, said first audio signal corresponding to said L signal from said source;

second means coupled to said source for providing a second audio signal originating in front of and to the right of said person, said second audio signal corresponding to said R signal from said source;

third means coupled to said source for providing a third audio signal originating in front of said person and between said first and second audio signals, said third audio signal corresponding to either one of the L signal minus the R signal or the R signal minus the L signal and fourth means coupled to said source for providing a fourth audio signal originating behind said person, said fourth audio signal corresponding to the other one of said L−R signal or said R−L signal, said first, second and third audio signals originating from a first common vertical plane, and said third and fourth audio signals originating from a second common vertical plane perpendicular to said first common vertical plane.

10. The system recited in claim 9 wherein said first means includes a speaker coupled to an amplifier having an input connected to the source.

11. The system recited in claim 9 wherein said second means includes a speaker coupled to an amplifier having an input connected to the source.

12. The system recited in claim 9 wherein said third means includes a differential circuit coupled to the source for producing said one signal, means coupled to the differential circuit for amplifying said one signal, and a speaker coupled to said amplifying means.

13. The system recited in claim 9 wherein said fourth means includes a differential circuit coupled to the source for producing said other one signal, means coupled to the differential circuit for amplifying said other one signal, and a speaker coupled to said amplifying means.

14. The system recited in claim 9 wherein said one signal is said L−R signal and said other one signal is said R−L signal.

15. The system recited in claim 9 wherein said one signal is said R−L signal and said other one signal is said L−R signal.

16. The system recited in claim 1 wherein said four speakers have substantially identical phase and frequency characteristics.

* * * * *